United States Patent [19]

Hwang

[11] Patent Number: 4,714,211

[45] Date of Patent: Dec. 22, 1987

[54] PACKING FILM DISPENSER

[76] Inventor: Harrison Hwang, No. 23, Lin Tsuo Road, Shenkang, Taichung Hsien, Taiwan

[21] Appl. No.: 885,770

[22] Filed: Jul. 15, 1986

[51] Int. Cl.[4] ..... B65H 23/06; B44C 7/00

[52] U.S. Cl. ..... 242/96; 242/75.4; 242/99

[58] Field of Search ..... 242/96, 99, 75.4, 55, 242/156, 156.2; 156/577; 53/390, 139.3

[56] References Cited

U.S. PATENT DOCUMENTS 4,102,513 7/1978 Guard ..... 242/75.4

4,535,951 8/1985 Riemenschneider ..... 242/96 X

FOREIGN PATENT DOCUMENTS 2065070 6/1981 United Kingdom ..... 242/96

*Primary Examiner*—John M. Jillions

*Attorney, Agent, or Firm*—Sherman & Shalloway

[57] ABSTRACT

A dispenser suited for applying plastic packing film under tension about an object of large volume and comprising a base with a handle and a roll support structure at opposite ends. The roll support structure comprises a tube that is adjustable relative to the base to accommodate different widths of rolls and has a means to secure the tube in a selected position, together with a tension applying means in connection with a handgrip attached to the upper end of the roll support structure permitting adjustment of the tension on the film during dispensing.

9 Claims, 5 Drawing Figures

PACKING FILM DISPENSER

BACKGROUND OF THE INVENTION

This invention relates to the field of hand-held dispensers particularly suited for dispensing and wrapping plastic packing film under tension about an object of large volume.

Heretofore, it has been the usual practice to use the plastic stretch film or stretch wrap to secure a plurality of containers on a pallet. The most conventional prior art film wrapping dispenser is shown in FIG. 1 and comprises a platform-shaped base 100, and handle 200 set on the base and a sliding pole 300. To use this kind of dispenser, as shown in FIG. 2, the plastic stretch film roll 400 is put onto the sliding pole 300 and can be rotated. By grasping the dispenser and moving around the object, the film is dispensed from the roll and wrapped around the object to cover it and protect it from moisture and the like.

In the above mentioned film dispenser, the length of the sliding pole 300 is fixed and is therefore suitable only for one size of stretching film. Although some attempts have been made to improved hand-held dispensers, for example, in U.S. Pat. No. 4,102,513, these have not been entirely satisfactory from the standpoint of a uniformity of wrap, tension adjustment, simplicity, durability, balance or ease of manipulation for various types of objects.

SUMMARY OF THE INVENTION

It is an object of this invention to provide a simple, durable and easy to use dispenser for stretch wrap film operations and the like.

It is a further object to provide a packing film wrap dispenser having good balance and facilitating the application of the film under substantially uniform tension across the full width of the film for a uniform wrap.

Another object of the present invention is to provide a film dispenser on which the roll is readily replaced.

It is a still further object of the present invention to provide a film dispenser which can be easily adjusted to accommodate different widths of film rolls and on which the tension on the film can be suitably adjusted for practical use.

A more complete understanding of these and other features and advantages of the present invention will become apparent from a careful consideration of the following detailed description of certain embodiments illustrated in the accompanying drawings.

DETAILED DESCRIPTION OF THE INVENTION

Figure 1:
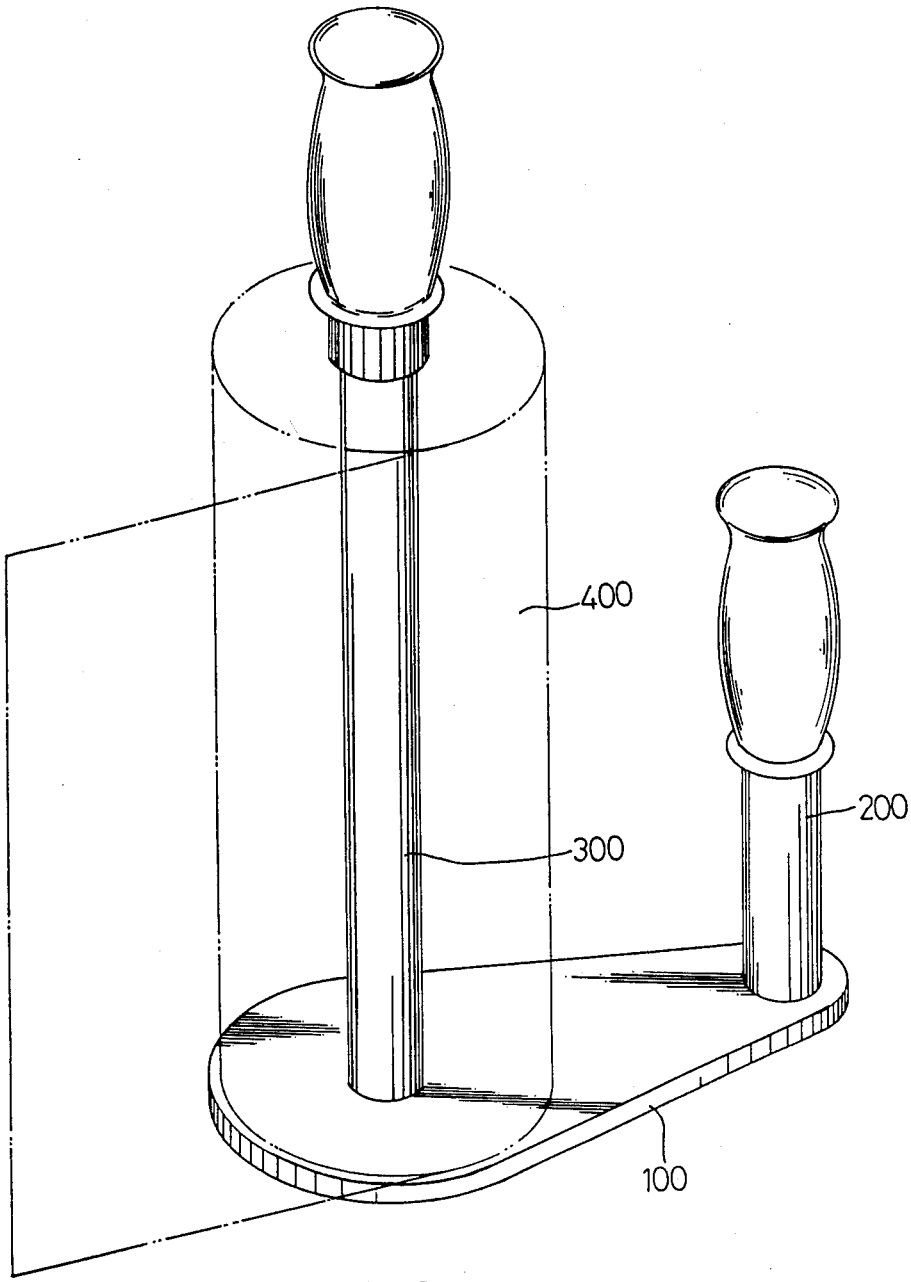
FIG. 1 PRIOR ART
FIG. 1 is a perspective view showing a fully assembled example of prior art dispensers.
Figure 2:
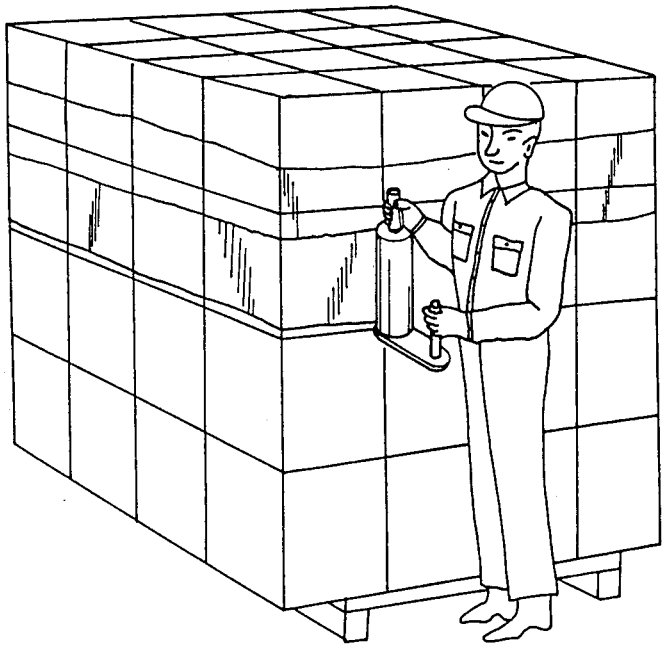
FIG. 2 PRIOR ART
FIG. 2 shows the common method of use of such film dispensers.
Figure 3:
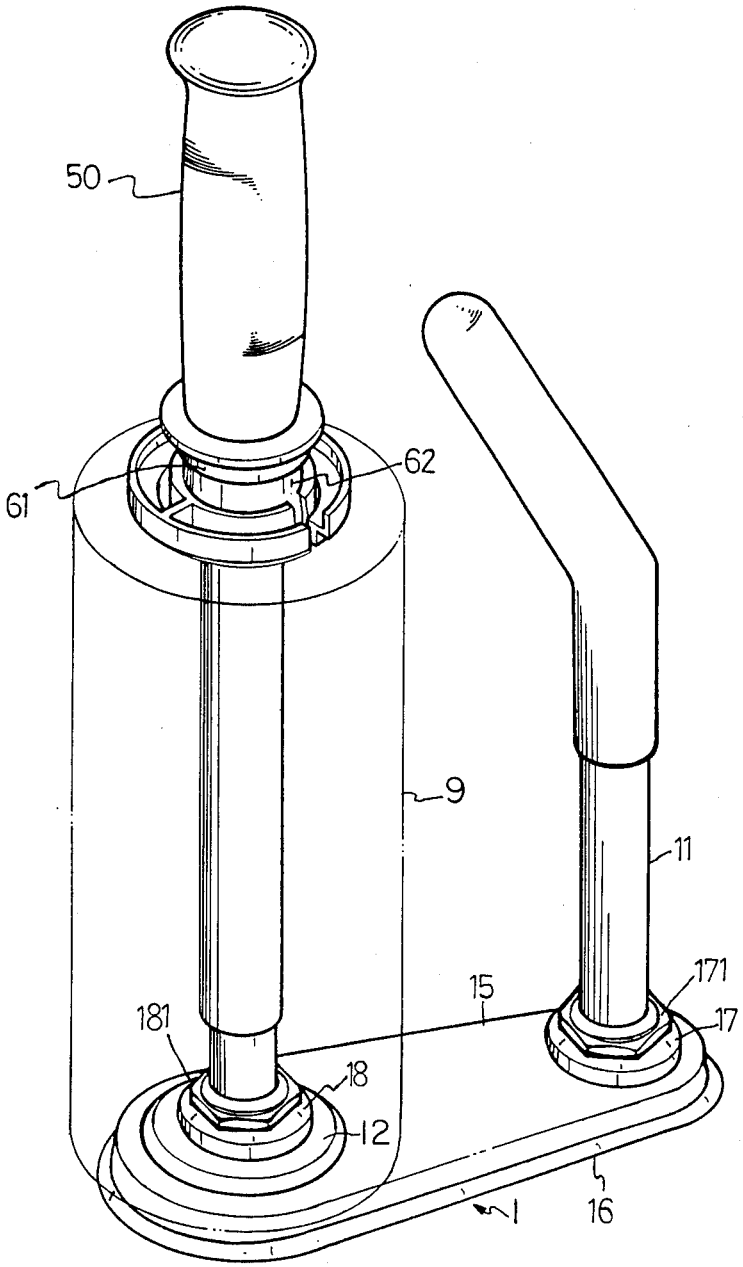
FIG. 3 is a perspective view showing a fully assembled embodiment of the invention.
Figure 4:
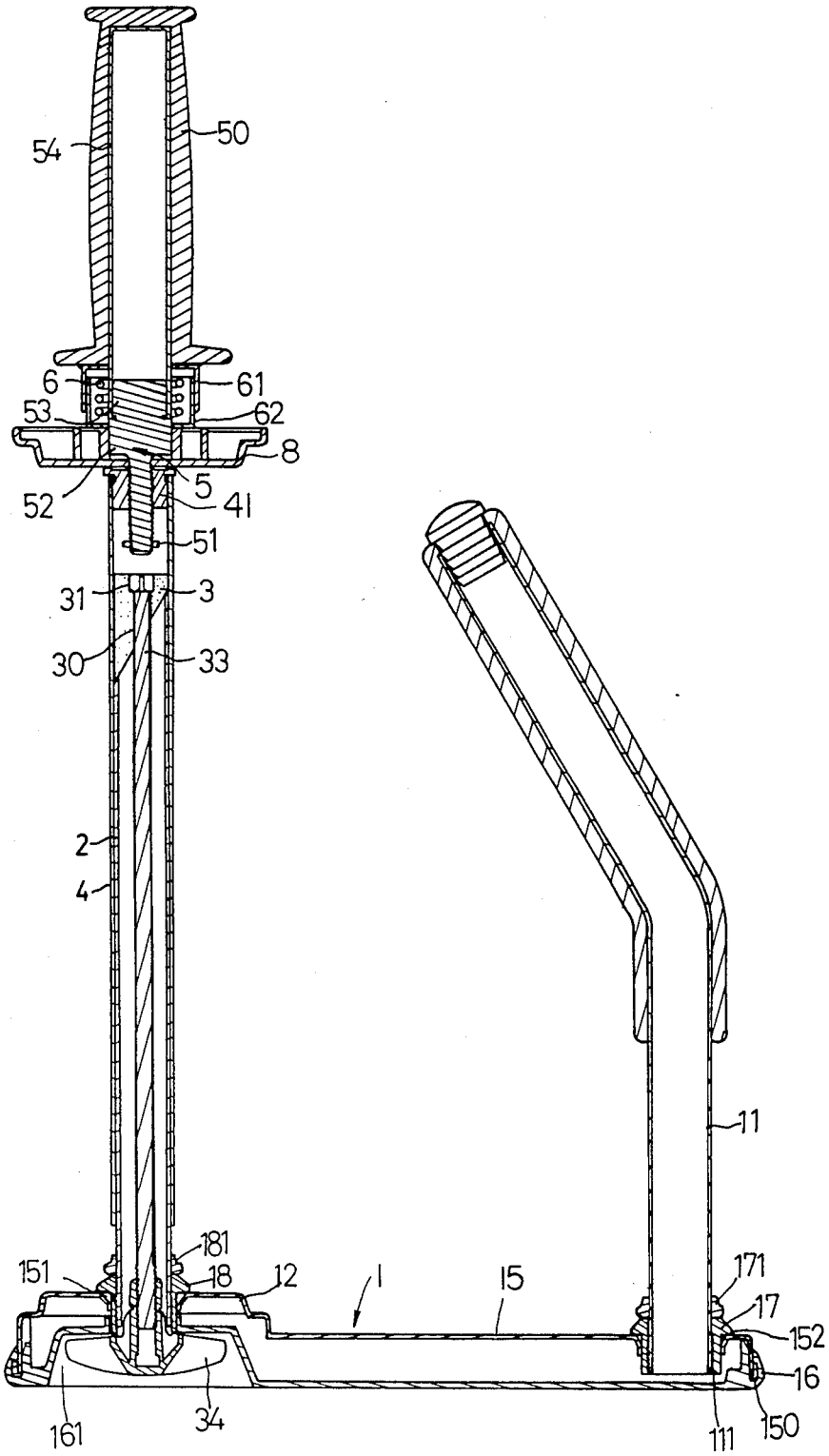
FIG. 4 is a side elevation cross-sectional view of the assembled embodiment of the invention.
Figure 5:
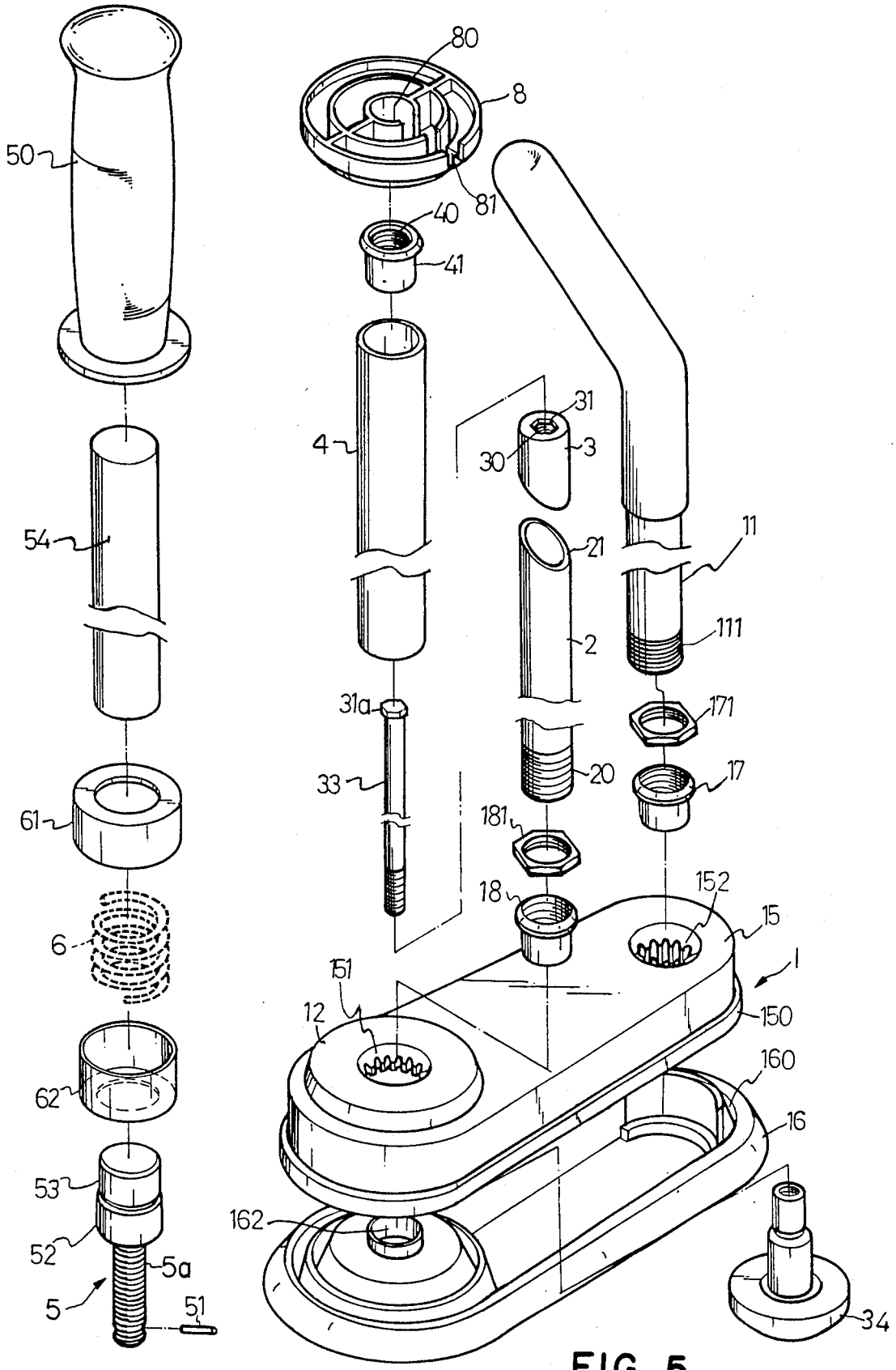
FIG. 5 is an exploded perspective view showing the components of the invention.

Referring to FIGS. 3, 4 and 5, there is shown a stretch film dispenser having a platform-shaped, rigid base 1 which, as shown in plan, has a wide end portion and becomes gradually smaller in width toward a narrower end portion with the ends thereof being rounded and semi-circular in shape. The base 1 is formed by a top plate 15 and a bottom plate 16, wherein the outer edge of the bottom plate 16 is formed as a mounting furrow 160. The lower edge 150 of the surrounding surface of the top plate 15 is bent upward forming a bead that fits into the furrow 160 thus enabling the top plate 15 and the bottom plate 16 to mount firmly together. On the top plate 15, at each of the ends, there is a hole or an opening 151, 152. Screw seats 17, 18 are insertable in each of the holes 151, 152 respectively. The bottom plate 16, at its wider end, has an upward concavity 161 with an opening 162 coaxial with the hole 151 in the top plate 15. A pipe-shaped handle 11 is screwed into the screw seat 17 at the narrower end of the base 1, the lower end of the handle 11 being formed with threads 111 and a locking nut 171 being provided to engage the handle and bear against the screw seat to hold the handle 11 fixed onto the base 1. The top plate 15 at the wider end of the base 1 is formed with a raised film roll support 12. Associated with the film roll support 12 is an adjusting means which includes an elongated pipe 2 fixed onto the film roll support 12 by means of threads at the lower end of the pipe 2 for engaging the screw seat 18 and a locking nut 181 engaging the pipe 2 and bearing against the screw seat 18. The upper end of the elongated pipe 2 is cut at an angle 21 to match with a pressing post 3 having a complimentary angle at its lower end. On the upper surface of the pressing post 3 there is a non-rounded hollow 31 coaxial with a hole 30 to accept a pillar or bolt 33 threaded at its lower end and with a head **31*a* of the same shape as the above-mentioned hollow 31. The bolt 33 passes through the hole 30 and the elongated pipe 2 to extend through the hole 162 in the concavity 161 of the bottom plate 16; an adjusting knob 34 is then screwed onto threads at the lower end of the bolt 33. Telescoping over the pipe 2 and the pressing post 3 is a sliding tube 4 having an inside diameter larger than the outside diameters of the pipe 2 and the pressing post 3. Inside the upper end of the sliding tube 4 is a nut 41. A screw post 5 with the threads 5*a* on its lower end screws into the nut 41. At the lower end of the screw post 5 there is also a pin 51 thrust through it. The upper end of the screw post 5 has a pair of short cylindrical sections 52, 53 wherein the upper section 53 is inserted into a support pipe 54 which itself is inserted into the handgrip 50. Beneath the handgrip 50 are a pair of telescoping mounting cases 61, 62 with openings opposite each other. The upper case 61 is welded onto the support pipe 54 and telescopes over the lower case 62 as shown in FIG. 4. Between the mounting cases 61, 62 and confined thereby is a spring 6. On the lower short cylindrical section 52 of the screw post 5 is a wheel 8. The wheel 8 is flat, with the center portion of the wheel concaved downward for clamping the stretch film roll 9 put on the base 1. At the center of the wheel 8 is a shaft hole 80 and between the shaft hole 80 and the outer edge of the wheel 8 there is an elongated opening 81 with its width being larger than the diameter of the screw post 5. As shown in FIGS. 3 and 4 in using the dispenser of this invention the wheel 8 is moved downward to separate it from the lower short cylindrical section 52 of the screw post then removed by means of the screw post passing through the elongated opening 81. Following this the adjusting knob 34 on the bottom plate 16 of the base 1** is rotated to loosen the pressing post 3 within the elongated pipe 2 thus enabling the sliding tube 4 to be adjusted to the desired length. At this point, the adjusting knob 34 is rotated in the opposite direction and the bolt 33 will pull on the pressing post 3 causing a distortion relative to the pipe 2 and the pressing post 3 will press against the inner wall of the sliding tube 4 to fix the sliding tube 4 in the desired position. The stretch film roll 9 is then put onto the dispenser by sliding it over the handgrip 50. After the stretch film roll 9 is put over the sliding tube 4 onto the base 1, wheel 8 is replaced on the screw post 5. Because the mounting case 62 is pushed downward to the wheel 8 by the spring 6, the wheel 8 will press against the upper end of the stretch film roll 9. By rotating the handgrip 50, the tension to the upper end of the stretch film roll 9 by the bottom of the wheel 8 will be adjusted to the optimum condition. When the user grasps the handle 11 and the handgrip 50, and moves the dispenser around the object (for example, a plurality of containers on a pallet as shown in FIG. 2), the wheel 8 and the stretch film roll 9 will be rotated and the plastic stretch film will be pulled from the roll for wrapping.

In the stretch film dispenser mentioned above, because the sliding tube 4 can be adjusted to any position, the distance between the wheel 8 and the base 1 is adjustable to accommodate stretch film rolls of different widths. After the plastic stretch film roll is put onto the base of the dispenser, the tension force on the plastic stretch film roll will be adjustable by rotating the handgrip. It is simple in structure, conveniently adjustable and suitable to any size of film.

Although the present invention has been described with a certain degree of particularity, it is understood that the present disclosure has been made by way of example and that changes in details of structure may be made without departing from the spirit thereof.

I claim:

1. A film dispenser particularly suited for wrapping plastic packing film under tension about an object of large volume wherein the dispenser comprises a rigid base tapering from a wide portion to a narrow portion, a handle extending from said narrow portion, an adjustable film roll support means extending from said wide portion and comprising an elongated wedging means telescoping within an outer tube, said wedging means cooperating with said outer tube to secure said tube at a desired extension, and tension applying means attached to said outer tube at the upper end thereof cooperating with said base to apply tension across the width of a roll of packing film.

2. The film dispenser of claim 1 wherein the wedging means comprises an elongated hollow pipe secured to said base by locking means and having an upper end cut at an angle, a pressing post having a complementary angle at its lower end and cooperating with said pipe, a bolt passing downward through said pressing post and said pipe and of sufficient length to reach said base, and a knob threaded to said bolt through said base from the underside thereof, whereby compressive force is applied to said pressing post upon tightening of said knob.

3. The film dispenser of claim 1 wherein the tension applying means comprises a handgrip having a threaded attachment means engaging a nut inserted in the upper end of said outer tube, a plate, and spring biased means confined between the hand grip and plate for urging said plate in the direction of said base to abut against an end of a film roll supported thereon.

4. The film dispenser of claim 3 wherein said spring biased means comprises a pair of telescoping cup-shaped mounting cases confining a helical spring therebetween and disposed between said handgrip and said plate, said spring biased means and said plate encompassing the threaded attachment means of said handgrip.

5. The plastic film dispenser of claim 4 wherein said plate is concave in the direction of the base and has a central shaft hole accommodating the threaded attachment means of the handgrip and an elongated opening between said shaft hole and the outer edge of said plate, the width of said opening being greater than the diameter of the threaded attachment means.

6. The plastic film dispenser of claim 5 wherein the threaded attachment means comprises a post having a lower threaded end extending into said nut in said outer tube and an upper cylindrical end inserted into a support pipe within said handgrip, said threaded end having a smaller diameter than said cylindrical end.

7. A film dispenser adapted to support a roll of plastic stretch wrapping film wherein the dispenser comprises a rigid base having a handle and an adjustable film roll support means extending from opposite ends of the same side thereof, an adjustment means within said film roll support means adapted to maintain said support means in a desired elongated condition and comprising a hollow pipe secured to such base, a pressing post cooperating with the upper end of said pipe, an elongated bolt having its head confined by said pressing post and extending through said pipe to said base and threaded at the end, and a knob threadably attached to said bolt at the underside of said base and cooperating with said bolt and said pipe to exert a compressive distorting force on said pressing post when tightened onto said bolt, an outer support tube over said adjustment means against which the distortion of said pressing post works, and a tension applying means attached to the upper end of said outer support tube and comprising a handgrip, a spring biasing means and a round plate, said spring biasing means confined between and cooperating with said handgrip and said plate to urge the latter toward said base, said plate being removable to facilitate replacement of rolls of film.

8. The film dispenser of claim 7 wherein adjustment of the film roll support means is achieved by rotating the adjusting knob between the base to relieve the compressive force on the pressing post allowing the post to disengage from the inner surface of the outer tube, sliding the outer tube and accompanying tension applying means over the adjustment means and away from or toward the base to thereby accommodate wider or narrower rolls of film and, when the desired position is reached, tightening the adjusting knob to reapply compressive force to the pressing post causing it to deform and wedge against the inner surface of the outer tube.

9. The film dispenser of claim 7 wherein tension is adjustably applied across the width of a roll of stretchable plastic film by the advancement or withdrawal of the handgrip relative to the base, the handgrip and accompanying tension applying means being threadably attached to the upper end of the outer tube by a threaded bolt wherein the threaded bolt has a cylindrical end inserted and confined by a support pipe within said handgrip and a reduced diameter threaded end cooperating with a nut inserted into the upper end of the outer tube whereby advancement of the handgrip and, thereby, the plate against a roll of film causes the spring biasing means to be compressed and to increase the tension thereagainst.

* * * * *